United States Patent [19]

Wessa

[11] Patent Number: 4,762,282

[45] Date of Patent: Aug. 9, 1988

[54] DEVICE FOR COMMINUTING SMALL ICE BODIES

[76] Inventor: Theo Wessa, Siedlung 19, 6751 Mackenbach/Pfalz, Fed. Rep. of Germany

[21] Appl. No.: 36,921

[22] Filed: Apr. 10, 1987

[30] Foreign Application Priority Data

Apr. 15, 1986 [DE] Fed. Rep. of Germany ..... 3612626

[51] Int. Cl.[4] ..... B02C 13/06; B02C 13/26

[52] U.S. Cl. ..... 241/190; 241/191; 241/243; 241/DIG. 17

[58] Field of Search ..... 241/190, 191, 243, 242, 241/292.1, DIG. 17

[56] References Cited

U.S. PATENT DOCUMENTS

| | | | |
|---|---|---|---|
| 295,819 | 3/1884 | Savits | 241/243 |
| 4,176,527 | 12/1979 | Unstromberg et al. | 241/190 X |
| 4,354,360 | 10/1982 | Fiske | 241/DIG. 17 X |
| 4,489,896 | 12/1984 | Cerroni | 241/190 X |
| 4,533,088 | 8/1985 | Lyston | 241/DIG. 17 X |

FOREIGN PATENT DOCUMENTS

| | | |
|---|---|---|
| 6921181 | 5/1969 | Fed. Rep. of Germany . |
| 1944142 | 3/1970 | Fed. Rep. of Germany . |
| 2108031 | 9/1971 | Fed. Rep. of Germany . |

*Primary Examiner*—Timothy V. Eley
*Attorney, Agent, or Firm*—Toren, McGeady & Associates

[57] ABSTRACT

A device for comminuting small ice bodies includes a housing without top and bottom walls in which a horizontally extending shaft is rotatably mounted. Disks forming beater knives are mounted on the shaft and counterknives in the form of cross-shaped breaking members are attached to the housing. Groups of adjacent disks define chambers in such a way that each chamber receives exactly one ice body. The chambers are arranged distributed over the circumference of the disks and along the length of the shaft in such a way that only a single ice body is comminuted at a given time. This reduces the power required for driving the shaft to a minimum.

9 Claims, 1 Drawing Sheet

DEVICE FOR COMMINUTING SMALL ICE BODIES

BACKGROUND OF THE INVENTION

1. Field of the Invention

The present invention relates to a device for comminuting small ice bodies. The device includes a housing without bottom and top walls with a horizontally extending shaft rotatably mounted in the housing. Beater knives are mounted on the shaft and counterknives are attached to the housing. The distance between the beater knives and the counterknives corresponds to the desired degree of comminution of the ice bodies.

2. Description of the Prior Art

Devices of the above-described type for the comminution of small ice bodies are known, for example, from German Auslegeschrift No. 19 44 142, German Auslegeschrift No. 21 08 031 or German Utility Model No. 69 21 181. These known devices include a driven shaft on which a number of knives are mounted next to each other. Fixed counterknives are arranged between the knives. The knives and counterknives are sickle-shaped and provided with a plurality of points for crushing the ice bodies.

The known devices described above have the disadvantage that they require a relatively powerful drive for the comminuting mechanism because it is entirely impossible to control the number of ice bodies being comminuted at a given time between the knives and counterknives. For the same reason, the grain size of the comminuted ice is also very irregular. The known devices must be designed structurally and with respect to drive power for loads which are rarely reached in practice.

In the known devices in which the ice bodies to be comminuted are introduced into the device from the side, only short structural lengths of the comminuting device and, thus, only a small comminuting capacity are possible.

In addition to the comminuting devices described above, machines are known which directly produce shaved ice which has the appearance of snow. A commercially available device of this type uses a screw which rotates within a vertically extending tube. The tube is subjected to deep freezing and is continuously sprayed with water, so that a layer of ice is formed continuously on the tube. This layer of ice is shaved off by means of the screw. The resulting shaved ice is conveyed to a discharge device by means of the screw. The product obtained with this device is a shaved ice which has a snow-like dull appearance which is considered unacceptable by consumers in many cases.

It is, therefore, the primary object of the present invention to provide a device of the above-described type in which the mechanism for comminuting the ice bodies has very small dimensions and requires very small drive power. In addition, a defined grain size of the comminuted ice bodies is to be obtained. Also, it should be possible to expand the device to practically any desired capacity.

SUMMARY OF THE INVENTION

In accordance with the present invention, a plurality of metal disks are fastened on the shaft, wherein segment-like recesses are cut out of a group of adjacent disks in such a way that a chamber is formed for receiving exactly one ice body.

Accordingly, in the device according to the invention, the individual ice bodies are held and conveyed in a defined manner in the chambers formed by the segment-like recesses in the metal disks and are comminuted by the fixed counterknives. This arrangement according to the present invention has the advantage that the grain size of the comminuted ice is very uniform and the power required is very small because the comminution takes place under defined conditions. In addition, if the ice bodies were clear initially, the comminuted pieces of the ice are also clear.

In accordance with another advantageous further development of the invention, several chambers are uniformly distributed over the circumference of the disks. It is also possible to arrange several chambers distributed over the length of the shaft. As a result, the comminution capacity is increased without requiring a change in the outer dimensions of the device.

In accordance with a preferred embodiment of the invention, the recesses are arranged distributed in such a way that only one ice body is being comminuted at any given time. Consequently, the power required for driving the shaft with the disks is reduced to the absolute minimum without impairing the capacity of the mechanism.

The disks preferably have profilings on the circumference. Thus, the ice bodies which are completely irregularly introduced from the top into the comminuting device are aligned in such a way that they are placed in the correct position into the chambers. This is particularly true if the ice bodies are conically or cylindrically shaped.

In accordance with a further development of the invention, limit disks without segment-like recesses can be arranged between the disks having segment-like recesses. By covering the spaces between two limit disks, particularly by roof-shaped covers connected to the housing, the loosely introduced ice bodies are conveyed in an improved manner to the comminuting points or chambers.

In the device according to the invention, the disks also act as beater knives. These beater knives and the stationary counterknives are provided with sharp edges and are serrated, so that the brittle ice bodies can be comminuted more easily.

The stationary counterknives are preferably constructed as cross-shaped braking members, so that the grain size of the comminuted ice becomes even more uniform. Also, the spacing between the rotating disks can be greater than in the mechanims according to the prior art.

The various features of novelty which characterize the invention are pointed out with particularity in the claims annexed to and forming a part of this disclosure. For a better understanding of the invention, its operationg advantages and specific objects attained by its use, reference should be had to the drawings and descriptive matter in which there are illustrated and described preferred embodiment so the invention.

DETAILED DESCRIPTION OF THE INVENTION

Figure 1:
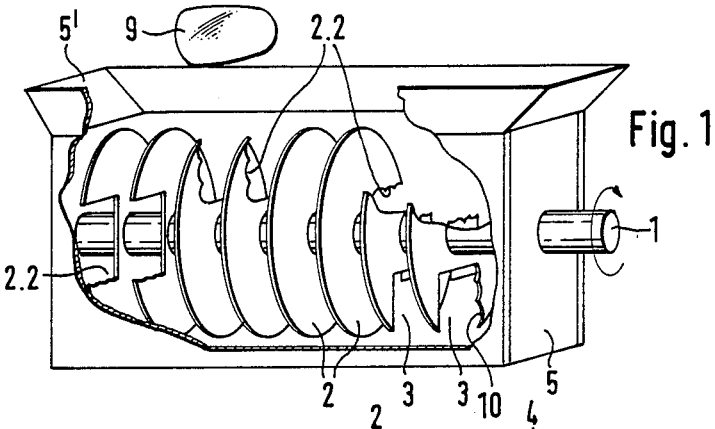
FIG. 1 is perspective, partially broken view of a first embodiment of the comminuting device for ice bodies according to the present inventionl.

The device illustrated in FIG. 1 includes a rectangular housing 5 formed by four side walls without top and bottom walls. A funnel-type inlet device 5' is provided at the top. A horizontally extending shaft 1 is mounted in the interior of the housing 5. Shaft 1 is driven by a motor, not shown.

Disks 2 are mounted in regular intervals on shaft 1. Segment-like recesses 10 are cut out of adjacent disks 2 in such a way that chambers 3 are formed. The size of each chamber 3 is such that it corresponds to the size of the ice bodies 9 to be comminuted. Each chamber can receive always only one ice body 9 of a predetermined size.

In the embodiment illustrated in FIG. 1, a plurality of chambers 3 are provided, however, these chambers are arranged distributed regularly around the circumference of shaft 1 or disks 2, so that the ice bodies placed in the chambers 3 are successively conveyed toward stationary counterknives 6 and are comminuted when they reach counterknives 6.

The recesses formed in disks 2 have sides 2.2. These sides 2.2 and the stationary counterknives 6 are provided with sharp edges and are serrated in order to be able to comminute the ice bodies 9 more easily.

Figure 2:
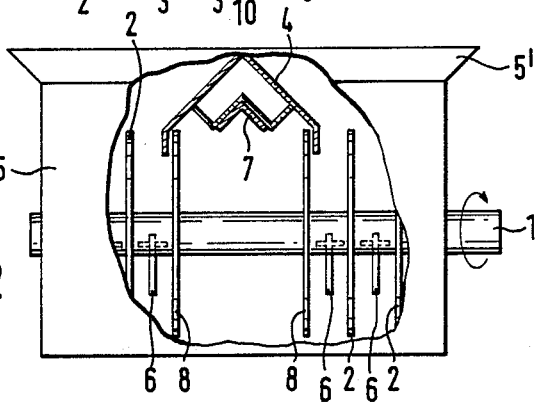
FIG. 2 is a front view of a second embodiment of the comminuting device of the invention, with the housing being partially broken.

In the embodiment illustrated in FIG. 2, additional limit disks 8 without segment-like recesses are mounted on shaft 1. These limit disks 8 form the end walls of the chambers 3 formed by the disks 2. The spaces between two limit disks 8 are bridged by means of roof-like covers 4 which can be mounted very easily in housing 5 by means of fastening angles 7.

Figure 3:
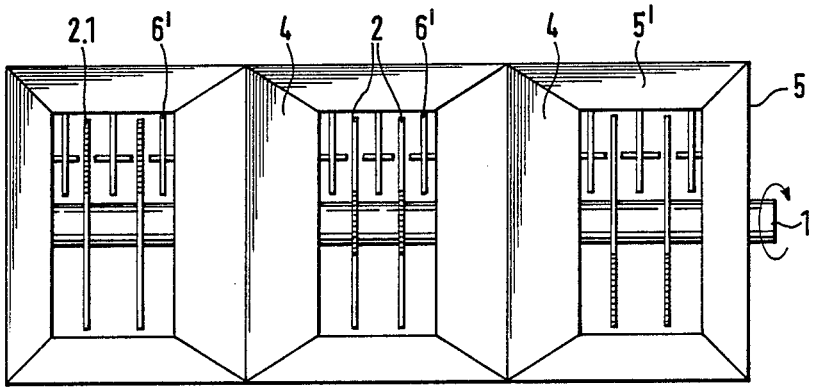
FIG. 3 is a top view of a third embodiment of the comminuting device according to the invention.

Finally, FIG. 3 shows a comminuting device which has three adjacent comminuting portions. The sides of the disks 2 are provided with a surface profiling 2.1, so that the ice bodies 9 introduced from the top can be aligned and are placed in the recesses 3 in the correct position. This is particularly true if the ice bodies are conically or cylindrically shaped.

In the embodiment illustrated in FIG. 3, the stationary counterknives are attached to the wall of housing 5 between the disks 2. The counterknives are preferably constructed as cross-shaped breaking members 6'. The ice bodies are conveyed against these breaking members 6' and are broken by disks 2 or by their sharp edges 2.2.

Since the chambers 3 receiving the ice bodies 9 are arranged offset relative to each other along the circumference of the disks 2 as well as along the length of the device in such a way that preferably at any given time only one ice body is being comminuted between disks 2 and counterknives 6, the drive, not shown, of shaft 1 must only be powerful enough to comminute a single ice body. In addition, blocking of the device is eliminated. The defined position of the ice body during the comminuting procedure serves to further increase the uniformity of the grains of the final product.

If the device according to the invention is to have a greater capacity, the housing and the shaft can be extended without problems. The power of the drive must only be increased if the extension of the device means that more than a single ice body is being comminuted between disks and counterknives at the same time.

While specific embodiments of the invention have been shown and described in detail to illustrate the application of the inventive principles, it will be understood that the invention may be embodied otherwise without departing from such principles.

I claim:

1. A device for comminuting small ice bodies of a predetermined size, comprising a housing having four walls and being open at the top and the bottom, a rotatable shaft horizontally mounted extending between two opposite of the four side walls, a plurality of metal disks forming beater knives fixedly connected on the shaft so as to rotate therewith, a plurality of stationary counterknives attached to the housing and extending between the disks, the spacing between the disks and the beater knives corresponding to the desired degree of comminution of the ice bodies, wherein groups of adjacent disks define segment-like recesses such that chambers for receiving an ice body each are formed by the recesses, wherein the size of each chamber corresponds to the size of an ice body.

2. The device according to claim 1, wherein a plurality of chambers are provided uniformly spaced apart over the circumference of the disks.

3. The device according to claim 1, wherein a plurality of chambers are arranged distributed over the length of the shaft.

4. The device according to claims 2 or 3, wherein the chambers are distributed such that only one ice body is comminuted at a given moment.

5. The device according to claim 4, comprising limit disks mounted on the shaft between the groups of disks forming chambers.

6. The device according to claim 5, wherein spaces are defined between two limit disks, the device further comprising roof-shaped covers attached to the housing for covering the spaces between two limit disks.

7. The device according to claim 1, wherein the disks include surface profilings.

8. The device according to claim 1, wherein the counterknives are cross-shaped breaking members.

9. The device according to claim 1, wherein the recesses define sides and the sides of the recesses and the counterknives have edges, the edges being sharp and serrated.

* * * * *